US006554399B2

(12) United States Patent
Wong et al.

(10) Patent No.: US 6,554,399 B2
(45) Date of Patent: Apr. 29, 2003

(54) INTERCONNECTED PRINTHEAD DIE AND CARRIER SUBSTRATE SYSTEM

(75) Inventors: Marvin G Wong, Woodland Park, CO (US); Timothy Beerling, Berkeley, CA (US); Evan P. Smouse, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 117 days.

(21) Appl. No.: 09/795,264

(22) Filed: Feb. 27, 2001

(65) Prior Publication Data

US 2002/0118254 A1 Aug. 29, 2002

(51) Int. Cl.[7] ..... B41J 2/14
(52) U.S. Cl. ..... 347/44; 347/50
(58) Field of Search ..... 347/40, 44, 50, 347/58, 42, 49

(56) References Cited

U.S. PATENT DOCUMENTS 5,648,804 A * 7/1997 Keefe et al. ..... 347/47
6,039,439 A * 3/2000 Komplin et al. ..... 347/65
6,068,367 A * 5/2000 Fabbri ..... 347/49
6,188,414 B1 * 2/2001 Wong et al. ..... 347/42
6,402,299 B1 * 6/2002 DeMeerleer et al. ..... 347/50

* cited by examiner

*Primary Examiner*—Anh T. N. Vo

(57) ABSTRACT

An interconnected printhead die and carrier substrate system for a printhead in hard-copy-producing devices used to print on print media includes a printhead die and a carrier substrate. The die and the substrate are coupled and each has an operative face separated from an inner face, and includes integrated circuits formed therein. At least three spacers are positioned between the die and substrate to define a space that is filled with an adhesive/under-fill layer. An electrical-connection region is located adjacent the inner faces of the die and substrate, and is effective to accommodate bilateral communication between integrated circuits formed on the die and the substrate. The die and the substrate may also have a stepped shape, and a cavity is formed by the stepped die and stepped substrate, with the electrical-connection region being located in the cavity. The electrical-connection region is also encapsulated with an encapsulant that may fill the cavity.

18 Claims, 4 Drawing Sheets

INTERCONNECTED PRINTHEAD DIE AND CARRIER SUBSTRATE SYSTEM

TECHNICAL FIELD

The present invention relates generally to certain construction and construction methods for making printheads of hard-copy-producing devices such as computer printers, graphics plotters and facsimile machines. More particularly, the present invention concerns the construction of a printhead of a thermal inkjet printer that includes one or more printhead dies, each with a stepped shape, interconnected to a carrier substrate that also has a stepped shape.

BACKGROUND ART

Ink-jet technology is employed in hard-copy-producing devices such as computer printers, graphics plotters and facsimile machines. By way of background, a description of ink-jet technology is provided in various articles in the Hewlett-Packard Journal such as those in the following editions: Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 5, No. 1 (February 1994).

An inkjet pen typically includes an ink reservoir and an array of inkjet printing elements, or nozzles. The array of printing elements is formed on a printhead. Each printing element includes a nozzle chamber, a firing resistor and a nozzle opening. Ink is stored in an ink reservoir and passively loaded into respective firing chambers of the printhead via an ink refill channel and ink feed channels. Capillary action moves the ink from the reservoir through the refill channel and ink feed channels into the respective firing chambers. The printing elements are formed on a common, so-called carrier substrate.

For a given printing element to eject ink a drive signal is output to that element's firing resistor. Printer control circuitry generates control signals which in turn generate drive signals for respective firing resistors. An activated firing resistor heats the surrounding ink within the nozzle chamber causing an expanding liquid bubble to form. The bubble forces ink from the nozzle chamber out the nozzle opening. A nozzle plate adjacent the barrier layer refines the nozzle openings. The geometry of the nozzle chamber, ink feed channel and nozzle opening defines how quickly a corresponding nozzle chamber is refilled after firing. To achieve high quality printing ink drops or dots are accurately placed at desired locations for desired resolutions. It is known to print at resolutions of 300 dots per inch and 600 dots per inch. There are scanning-type inkjet pens and non-scanning type inkjet pens. A scanning-inkjet pen includes a print head having approximately 100–200 printing elements. A non-scanning type inkjet pen includes a wide-array or page-wide-array print head. That type of print head includes more than 5,000 nozzles extending across the width of a page. Nozzles for page-wide-array print heads like that are controlled to print one or more lines at a time.

In connection with forming printing elements on carrier substrates, a printhead die is connected to such a substrate. The outer surfaces of conventional printhead dies have a linear, non-stepped shape. As a result, the die is adhered in place in a recess formed in the substrate, as a block being placed in a recess. When the die and substrate are connected, the outer surface of the die adjoins the outer surface of the substrate. To make necessary electrical connection between printer-operational integrated circuits (ICs) located in the die and substrate, electrical connectors such as wire bonds or tape-automated bonding (TAB) circuit coupons are used. Those electrical connectors are placed to span the intersection of the outer faces of the die and substrate.

There are problems associated with locating the electrical connectors adjacent the outer face of the die and substrate. Those problems are associated with placing a critical component of the printhead, the electrical connectors for the die and substrate, in a location subject to attack/degradation by the printhead environment. That environment includes chemical attack on the connection via ink, and degradation due to abrasion when devices know as wipers are used during a conventional cleaning operation.

DISCLOSURE OF THE INVENTION

The invention is an interconnected printhead die and carrier substrate system for a printhead in hard-copy-producing devices used to print on print media and includes a printhead die and a carrier substrate. The die and the substrate are coupled and each has an operative face separated from an inner face, and includes integrated circuits formed therein. At least three spacers are positioned between the die and substrate to define a space that is filled with an adhesive/under-fill layer. An electrical-connection region is located adjacent the inner faces of the die and substrate, and is effective to accommodate bilateral communication between integrated circuits formed on the die and the substrate.

The die and the substrate may have what is characterized as a stepped shape, and a cavity is formed by the stepped die and stepped substrate, with the electrical-connection region being located in the cavity. The electrical-connection region is also encapsulated with an encapsulant that may fill the cavity. The operative face of the die is not encapsulated, and one version of the system includes having the operative faces of the die and the substrate may also be covered with a protective coating having a differentiated thickness.

The spacers may be formed integrally with the carrier substrate as a stand-off or bump extending upwardly from substrate in the range of about 3 mils (0.003 inches). At least three and preferably four bumps are formed on the carrier substrate in positions opposing the four corners of generally rectangularly shaped printhead die. Having at least three bumps defines a level plane for exact placement of the die in desired position over the substrate.

Another feature of the invention is a two-step process of coupling die 312 to substrate 314. The first step is to temporarily tack the die to the substrate by applying a suitable first adhesive to the upper ends of the bumps. A suitable curing process is performed, and the result is to precisely fix the die temporarily in a desired position. That position is 3 mils from the opposing surface of the substrate. The second step is to apply an second adhesive/under-fill material to fill in the space between the die and the substrate. The two-step die-substrate coupling process improves planarity of the die and its corresponding operative face. By following the two-step process with two different adhesives, the possibility of undesired lateral micro-movement of the die relative to the substrate is minimized.

The invention provides an interconnected system in which protection occurs in regions of the die and substrate where electrical connections are made. The stepped features of the die and substrate cause the electrical-connection region to be located inwardly of the ink-flow architecture of the printhead in a place that is protectible by encapsulants or other protective materials/mechanisms. In addition, the stepped feature die places the operative face of the die in the desired location closest to the print media.

These and additional objects and advantages of the present invention will be more readily understood after consideration of the drawings and the detailed description of the preferred embodiments which follow.

DETAILED DESCRIPTION OF THE PREFERRED EMBODIMENT AND BEST MODE OF CARRYING OUT THE INVENTION

From an overview, there will be discussed below various embodiments of the present invention, and it should be understood that a preferred one of the various disclosed embodiments will depend upon the particular application and will be apparent to those skilled in the art.

Figure 1:
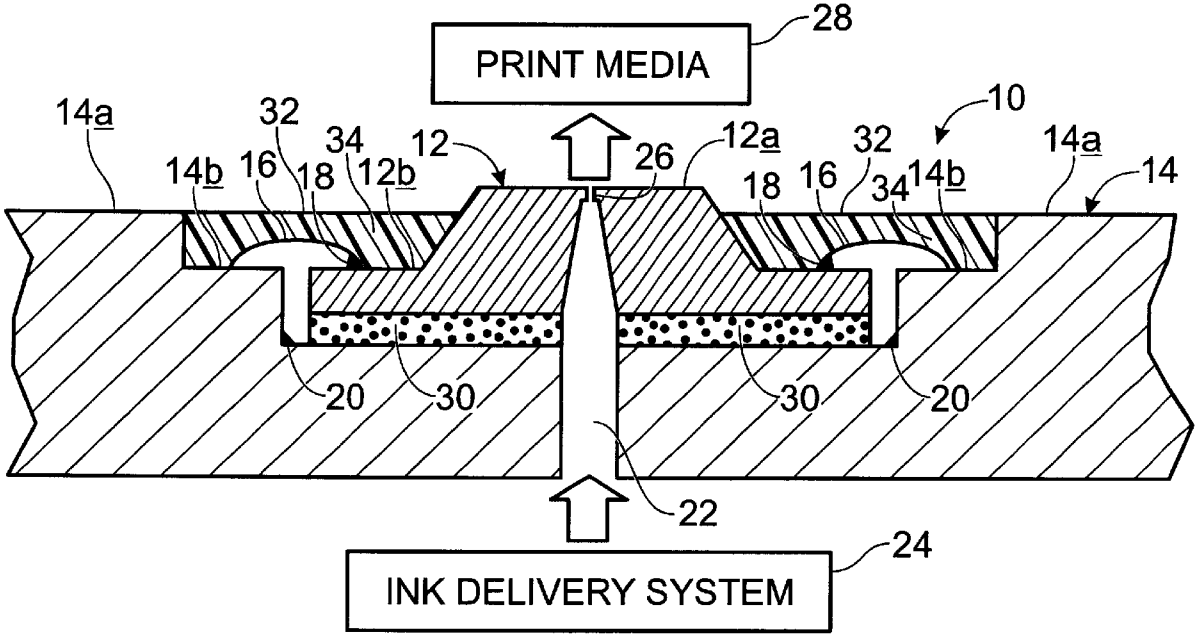
FIG. 1 is a fragmentary, sectional view of an interconnected stepped printhead die and carrier substrate system in accordance with a first embodiment of the present invention.

Referring to FIG. 1, a first embodiment of the invention is shown at 10 including a stepped printhead die 12 interconnected to a stepped carrier substrate 14. Die 12 includes the various components (undepicted) discussed in the above Background section. Fabrication of the stepped shape of the die and substrate is accomplished according to any suitable method, and preferably according to the method described in co-pending U.S. patent application Ser. No. 09/070,864 entitled Inkjet Printhead for Wide Area Printing, filed Apr. 30, 1998, which application is incorporated herein by reference. Suitable electrical connectors such as wirebonds, schematically depicted at 16, provide electrical connection or communication between printer-operational integrated circuitry located on die 12 and printer-operational integrated circuitry located on substrate 14. That electrical connection is shown schematically by die-connection points 18 and substrate-connection points 20. Those points may take the form of gold-to-gold metal bonds, solder joints or diffusion bonds under suitable temperature and pressure.

The combination of wirebonds 16, die-connection points 18 and substrate-connection points 20 make up what may be thought of as an electrical-connection region of the interconnected printhead die and substrate system of the present invention. A suitable ink slot 22 is formed in the die and substrate to provide a channel for ink to flow from a suitable ink delivery system, shown schematically at 24. Suitable ink delivery systems typically attach ink containers in an on- or off-axis orientation to direct ink into the ink slot via tubes or other suitable conduits. Ultimately, ink droplets are ejected from an operative (or outer) face 12*a* of die 12 via suitable ink-flow architecture (including nozzles), depicted schematically at 26, to print media shown schematically at 28.

As will be described in connection with FIG. 7, the electrical connectors may also be tape-automated bonding (TAB) circuit coupons or other suitable connectors that provide electrical connection or communication between printer-operational ICs located on the die and substrate. Examples and further details of typical printer-operational ICs are described in U.S. Pat. No. 6,123,410 to Beerling et al., assigned to Hewlett-Packard Company and entitled Scalable Wide-array inkjet printhead and method for fabricating same. That patent also includes further details of typical ink-flow architecture associated with printhead dies such as die 12 and operative (or outer) face 12*a* ultimately to enable ink to be ejected from the die to print desired information on print media at a desired resolution.

Still referring to FIG. 1, die 12 and substrate 14 are interconnected by an adhesive/under-filling material shown as an adhesive layer 30. A suitable adhesive/under-filling material must have a suitable wicking property so that it can effectively fill the space between the die and substrate after the die has been moved to the depicted position over the substrate. That space includes the space under die 12 as shown in FIG. 1, and the spaces on either side of die 12 where electrical connectors 16 are shown. Those connectors do not extend along the entire side of the die and substrate so that there are spaces between the sides as well as the space below the die filled with adhesive layer 30. The corresponding space along the sides of the die are best shown in the embodiment depicted in FIG. 5, and the required wicking property of adhesive/under-filling material will be described further in connection with FIG. 5.

A suitable under-filling material must also and must provide the usual system requirements such as temperature resistance, chemical compatibility and cure time. One such suitable under-filling material is a standard chip coat material sold under the trademark NAMICS™. For applications where there is a single die (as opposed to multiple dice such as that described in U.S. Pat. No. 6,123,410), or for applications where there are multiple dice but die alignment is not relatively critical, a suitable adhesive/under-filling material may be a thermoplastic adhesive or a B-staged epoxy (thermoset) adhesive.

FIG. 1 shows that die 12 has a stepped shape in which operative face 12*a* is outward of electrical-connection (or inner) face 12*b*. Similarly, substrate 14 is also formed with a stepped feature so that outer face 14*a* is outward of electrical-connection (or inner) face 14*b*. The stepped features of die 12 substrate 14 is important to protect regions of the die and substrate where the electrical connections are made (adjacent wirebonds 16 as described above), and to allow outer face 12*a* (with its ink-flow architecture including nozzle opening(s)) to be the component of the inkjet pen that is closest to the print media. The stepped features of the die and substrate cause wirebonds 16 to be inward or away from outer face 12*a* and outer face 14*a*.

Concluding description of FIG. 1, the electrical connection region is preferably, suitably encapsulated with an encapsulant 32 for environmental protection of the electrical connection. Encapsulant 32 is dispensed into a cavity 34 defined by stepped die 12 and stepped substrate 14. The environment of an inkjet printhead is severe and encapsulation provides an effective way to limit degradation of the electrical connection region by ink or other degrading/contaminating elements. The environment is also severe because mechanical wipers move across operative face 12*a* and a suitable encapsulant also protects the electrical connection against wear/damage due to the wipers. Proposed encapsulants may be a photo-imageable polyimide, a curable BCB resin, or a curable epoxy resin. Depending upon which one is used, suitable cure processes should be followed to ensure the most effective ink resistance. The photo-imageable polyimide has the advantage of providing excellent ink resistance and effective adhesion. While FIG. 1 shows different materials being used for adhesive/under-filling layer 30 and encapsulant 32, it has also been found that the NAMICS™ chip coat material is effective both as a wickable under-filling layer and as a chemical and mechanical wear-resistant encapsulant (as will be described further in connection with FIG. 5).

For purposes of this invention, die 12 and substrate 14 may be any suitable material, with die 12 typically being formed of silicon, and substrate 14 being formed of various materials including silicon. Another advantage of the interconnected stepped die and substrate of the present invention is that the encapsulant can be dispensed into cavity 34 rather than the conventional way of being applied over arched wires on a flat or slanted surface. Those conventional applications cause problems because encapsulants generally have a thixotropic feature that inhibits flow on the flat or slanted surfaces. Insufficient flow may cause insufficient encapsulation making the electrical connection vulnerable to degradation/failure from ink.

Figure 2:
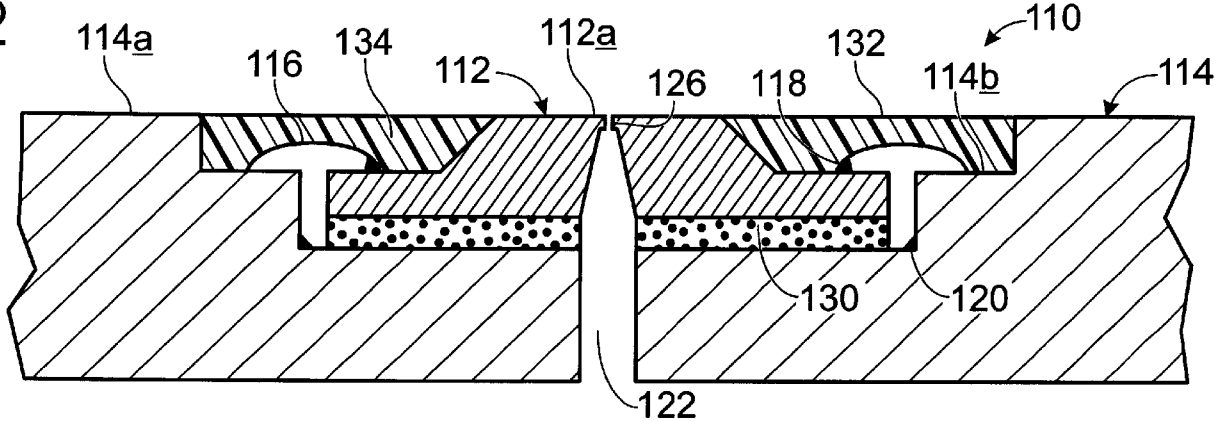
FIG. 2 is similar to FIG. 1 showing a second embodiment of the invention.

Referring to FIG. 2, operative face 12*a* extends outwardly the same amount as outer face 14*a* so that the two faces are in essentially the same plane. By making the two corresponding surfaces at the same level or in the same plane, the encapsulant is located at the same level as outer face 12*a* (more particularly although undepicted, the orifice plate associated with conventional printheads). This orientation protects the traces and other features of the corners of die 12 from cleaning wipers used when printheads are serviced.

Figure 3:
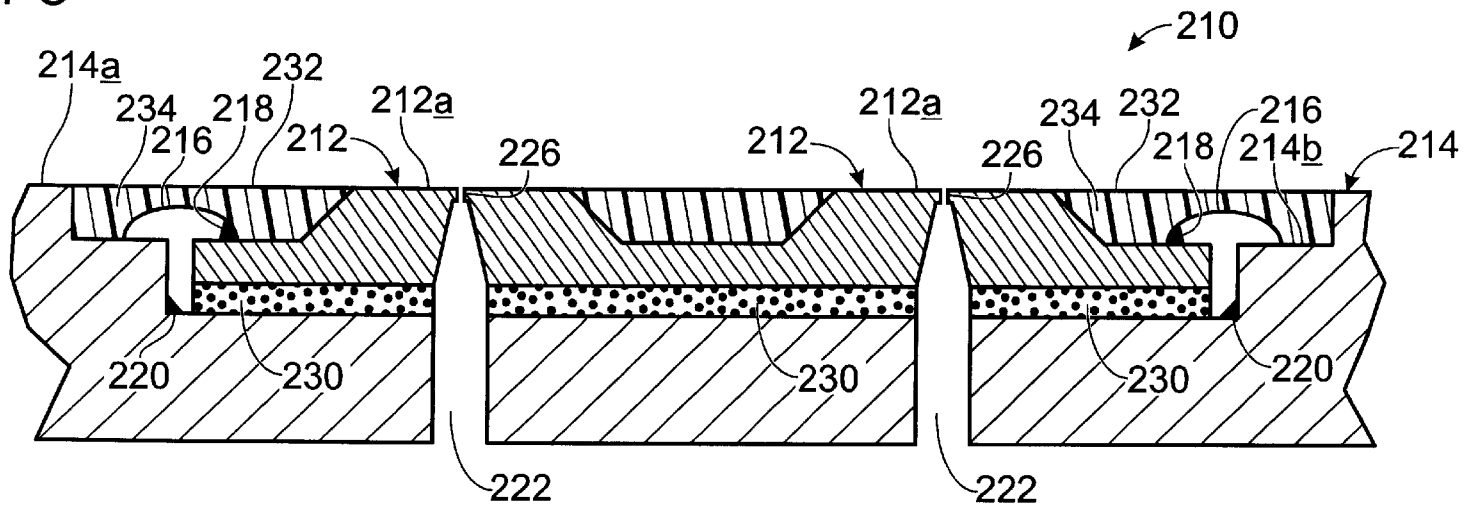
FIG. 3 is similar to FIGS. 1 and 2 showing a third embodiment of the invention.

FIG. 3 shows a third embodiment of the invention at 210 with dual ink slots 222. The invention may be formed with as many rows of ink slots as desired for the particular application, and the dual ink slot depiction is meant to be representative of those possible variations. FIG. 3 shows that a central region of dual die 212 has a stepped region that is filled with encapsulant 232. While not depicted, dual printhead die 212 may be formed with no central stepped region, thereby providing a location for the typical so-called active devices of the inkjet printhead including FET resistors, analog circuitry and digital circuitry.

Figure 4:
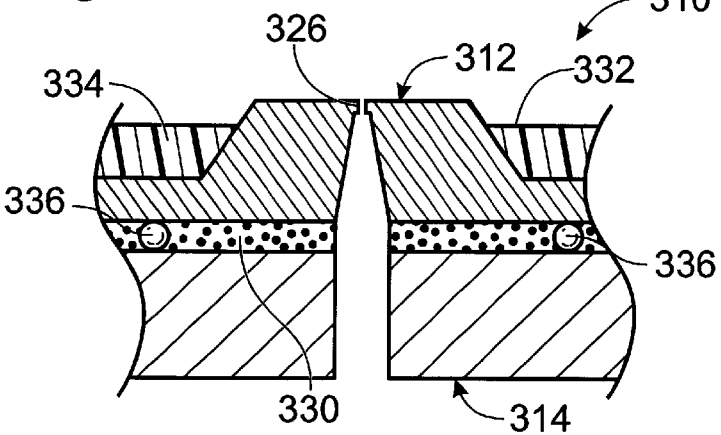
FIG. 4 is similar to FIG. 1 showing a fourth embodiment of the invention with a spacer element located between the die and substrate.

FIG. 4 illustrates a fourth embodiment at 310 showing an alternate way of seating printhead die 312 on carrier substrate 214. To mount the printhead die, the die may be pressed to the carrier substrate after a combination of spacer elements 336 such as so-called solder bumps and associated wetting pads are placed in the region occupied by adhesive/under-filling layer 330. The result is to allow self-alignment by solder surface tension during a so-called reflow process. As described further in U.S. Pat. No. 6,123,410, solder bumps 336 are placed in appropriate places between die 312 and substrate 314 in the region occupied by adhesive layer 330 (as shown in FIG. 4, but also described in further detail in connection with FIG. 5 of U.S. Pat. No. 6,123,410) prior to moving die 312 into place on substrate 314.

While undepicted in the simplified version shown in FIG. 4, so-called wetting pads are located on opposing surfaces of die 312 and substrate 314 so that solder bumps 336 are sandwiched by the pads. Then, with the die pressed to the carrier substrate and being separated by solder bumps 336, the solder is heated to liquefy it. Liquefied solder then flows along the wetting pads and pulls the die into precise alignment with the substrate. It has been demonstrated that these so-called solder-reflow forces align the respective components to within approximately one micron. By precisely locating wetting metals using a photolithographic and other known deposition processes print head dies like die 312 can be precisely placed and aligned on substrate 314 to within desired tolerances. After this self-alignment process is carried out, a suitable thermally-curable adhesive/under-filling material 330, and then a thermal curing process is carried out to cure the adhesive and complete interconnection of die 312 and substrate 314.

Figure 5:
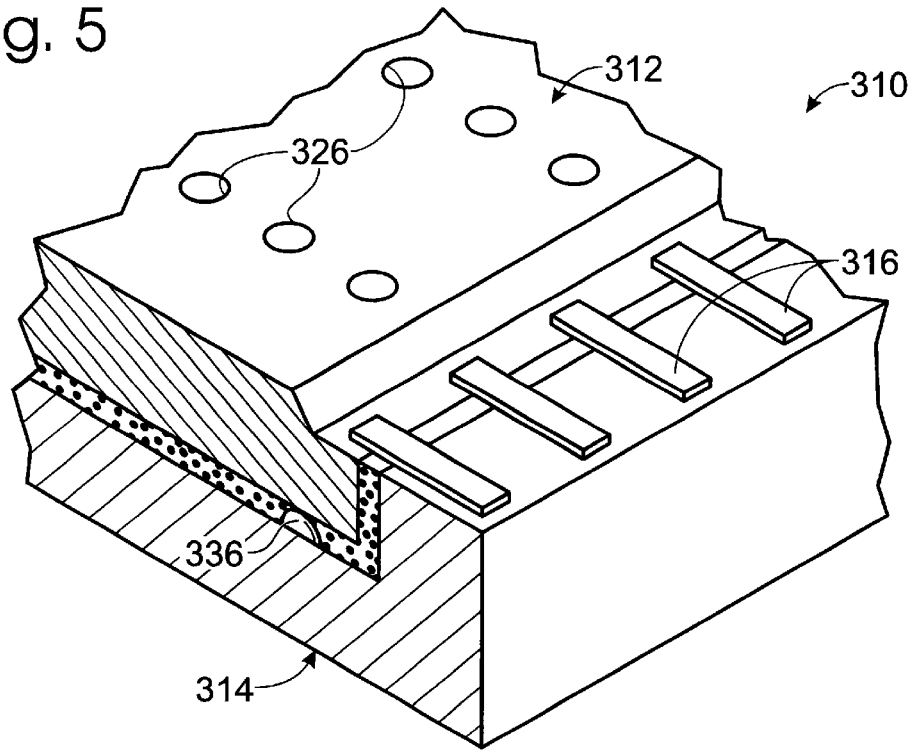
FIG. 5 is a fragmentary, isometric view of the fourth embodiment of the invention shown in FIG. 4, and also showing an alternate form of a spacer element located between the die and substrate.

FIG. 5 is another view of the fourth embodiment of FIG. 4, showing another type of spacer element 336 that has been found to be particularly effective in connection with a to-be-described process of coupling printhead die 312 to carrier substrate 314. As shown in FIG. 5, spacer 336 is formed integrally with carrier substrate 314 as a stand-off or bump extending upwardly from substrate 314 in the range of about 3 mils (0.003 inches). At least three and preferably four bumps 336 are formed on the carrier substrate in positions opposing the four corners of generally rectangularly shaped printhead die 312. Having at least three bumps defines a level plane for exact placement of die 312 in desired position over substrate 314. It has been found that having the extra fourth bump allows for possible micro-irregularities in the mating surfaces of the die and substrate to ensure that at least three bumps contact the under surface of die 312 when it is placed in position. In FIG. 5, electrical connectors 316 are depicted in another typical schematic form, but as described in FIG. 1, could take the form of suitable wire bonds.

Still referring to FIG. 5, there is performed the following two-step process of coupling die 312 to substrate 314. The first step is to temporarily tack the die to the substrate by applying a suitable first adhesive (undepicted) to the upper ends of bumps 336. A suitable curing process is performed, and the result is to precisely fix die 312 temporarily in a desired position. That position is 3 mils from the opposing surface of substrate 314. Suitable first adhesives include a UV-curable type sold under the trademark LOCTITE™ 3100 and an anaerobic-cure type sold under the trademark LOCTITE™ 4204. Of those two, the LOCTITE™ 3100 material has been found to be particularly effective.

The second step is to apply an second adhesive/under-fill material such as the NAMICS™ material describe above to fill in the space between die 312 and substrate 314. The material has been applied manually using a syringe and needle, but it is intended that a suitable dispensing machine could be used to direct the under-fill material downwardly into the space between the die and substrate so that it fills the area as shown in FIG. 5. FIG. 5 is fragmentary in that it shows only a portion of the recessed region (also referred to as a cavity) formed by the stepped shapes of the die and substrate (for example, refer back to FIG. 4 and FIG. 1). It has been found that the NAMICS™ material could be used to form the above-described adhesive/under-fill layer (layer 330 in FIG. 4) and as an encapsulant (like encapsulant 332 in FIG. 4). The NAMICS™ material has the required wicking property to effectively form the under-fill layer, and yet is also suitably ink- and wear-resistant to be an effective encapsulant.

Still referring to FIG. 5, the two-step die-substrate coupling process improves planarity of the die and its corresponding operative face. By following the two-step process with two different adhesives, the possibility of undesired lateral micro-movement of the die relative to the substrate is minimized. That improved planarity is particularly important for this application because of the extreme needs for exact placement of the die relative to the substrate to define rows of ink-flow architecture (including nozzles) such as the five rows shown in to-be-described FIG. 6. For thermal inkjet applications, a typical tolerance is ¼ of a dot row of misalignment at 1200 dots per inch (dpi), which translates to $1/10{,}000$ inch.

With respect to spacer 336 in FIG. 5, it could also take the form of an external element such as a suitably dimensioned piece of stainless steel, gold or ceramic. The shape of the spacer could take various forms as well including a cylindrical shape.

With the above description in mind, the coupling method could be thought of as a method of coupling printhead die 312 and carrier substrate 314. The steps of that methods may also be thought of as choosing at least three spacers 336 to position between selected regions of the die and substrate to define a space, positioning spacers 336 between the selected regions of the die and substrate, adhering spacers 336 to the die and substrate using a first curable adhesive, and after curing the first adhesive; adding a second curable adhesive to fill the space. The method may further include the step of forming spacers 336 integrally with the substrate as bumps upwardly extending therefrom. The method may also involve choosing a first curable adhesive that is different from the second curable adhesive.

Figure 6:
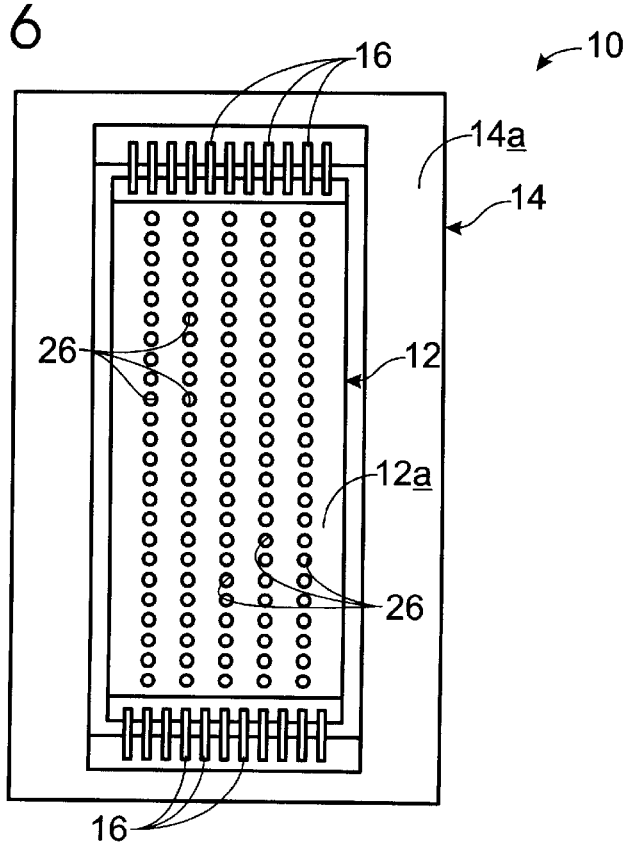
FIG. 6 is a plan view of the first embodiment shown in FIG. 1 without the encapsulant covering the electrical connectors.

FIG. 6 shows a plan view of the first embodiment shown in FIG. 1 if that embodiment were formed with five ink slots, such as ink slot 22 in FIG. 1. Five rows of associated ink-flow architecture (including nozzles) 26 are disposed across operative face 12*a* of die 12. FIG. 6 illustrates generally what may be thought of as the operative end of the overall printhead including operative face 12*a* of printhead die 12 and operative face 14*a* of carrier substrate 14. Electrical connectors 16 are located adjacent inner faces 12*a* and 14*a* of printhead die 12 and carrier substrate 14 (refer back to FIG. 1). As described and shown above in connection with FIG. 1, this inner location of the electrical connectors allows for filling in of the space over the electrical connectors with encapsulant 32 (not depicted in FIG. 6 to allow a view of the electrical connectors in the inner position relative to operative faces 12*a* and 14*a*).

Figure 7:
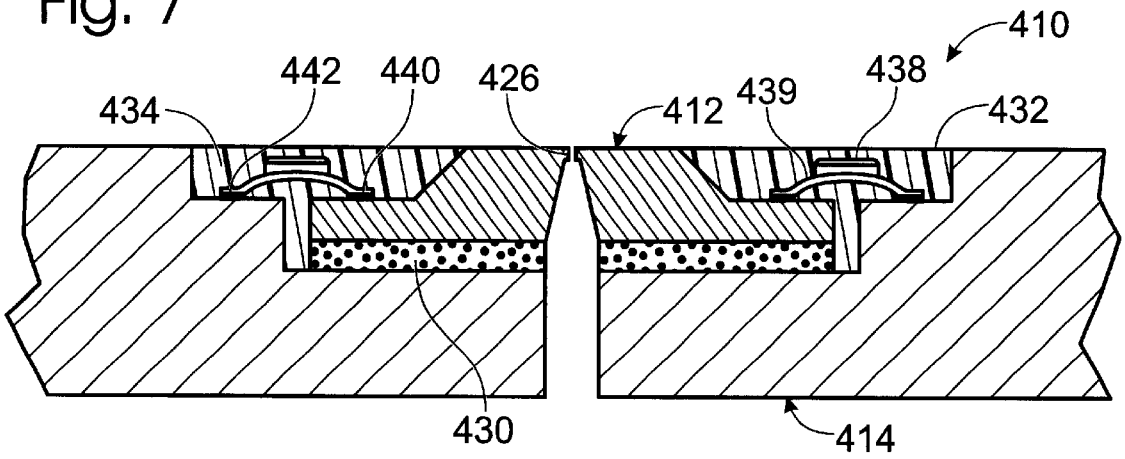
FIG. 7 is similar to FIG. 2 showing a fifth embodiment of the invention.

FIG. 7 shows a fifth embodiment at 410 and, in a simplified way, there is shown interconnected printhead die 412 and substrate 414 being used with a TAB circuit coupon 438 providing the necessary electrical connection between die 412 and substrate 414. Each TAB circuit coupon 438 has an associated TAB-bonded interconnection 439 that spans from die 412 to substrate 414. The TAB circuit allows die-connection points 440 and substrate-connection points 442 to perform similar functions as die-connection points 18 and substrate-connection points 20 in FIG. 1.

Figure 8:
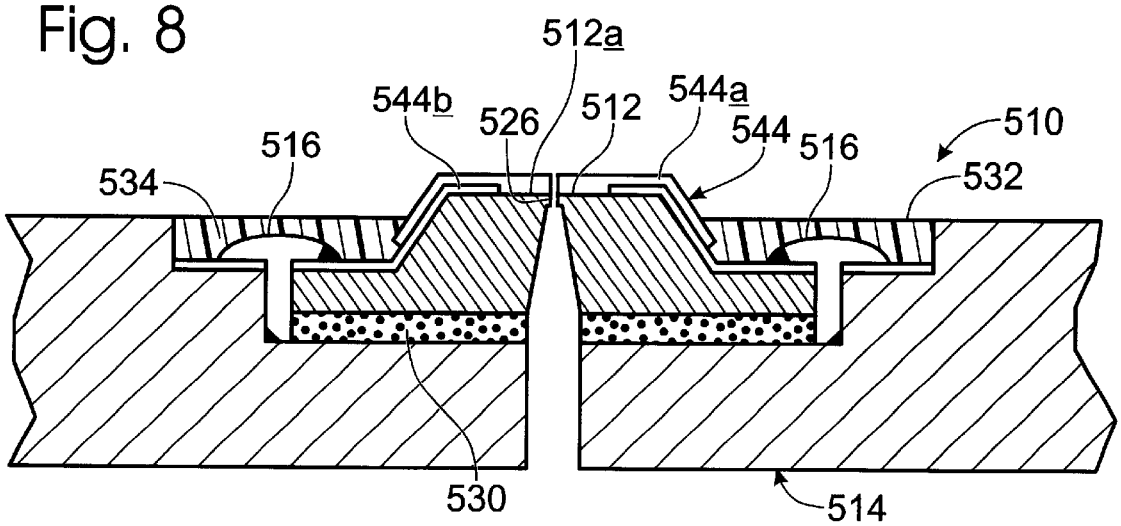
FIG. 8 is similar to FIG. 1 showing a sixth embodiment of the invention.

FIG. 8 shows a sixth embodiment at 510 with a layer of a protective coating 544 deposited on die 512 to provide additional environmental and abrasion protection for the traces and other features of the corners of die 512 from cleaning wipers used when printheads are serviced. Protective coating 544 may be a suitable layer of a polymeric material, glass, ceramic or other material that can be selectively removed in the region where wire bond 516 (or a TAB circuit coupon/TAB-bonded interconnection) is to be connected to die 512. That selective removal results in a differentiation in the thickness of the coating so that it is thicker at 544*a* adjacent outer face 512*a*, and it is thinner at 544*b* adjacent wire bonds 516.

Reference is now made back to FIG. 1 and to the beginning of this description in which reference was made to the incorporated, co-pending patent application that describes a preferred method of fabricating the stepped shape of the die and substrate. To augment that fabrication method, and to obtain a silicon printhead die with a relatively large stepped feature, i.e. optimizing separation between the outer and inner faces of the die, a buried silicon dioxide (or oxide) wafer might be used. The buried oxide will act as an etch stop for an anisotropic wet etch, commonly used in silicon bulk micromachining. The shape of the silicon die after wet etch will be determined by a so-called hard mask used to selectively block the anisotropic etchant. To form ink slot 22 for printhead 12, an additional etch step will be required to break through the buried oxide. A dry etch step can be used to etch through the oxide, and selectivity to the silicon forming die 12 will not prevent the etch step from working. The formed ink slot will be the only region of die 12 where the buried oxide will be removed. Once the oxide is selectively removed, the anisotropic etch can be completed to complete formation of the ink slot.

INDUSTRIAL APPLICABILITY

The invented system and method has broad applicability in connection with construction and construction methods for making printheads of hard-copy-producing devices such as computer printers, graphics plotters and facsimile machines. Stepped dies and stepped carrier substrates interconnected according to the invention will provide an effective way to limit degradation of the electrical connection region of the printhead. The invented system and method is inexpensively manufactured using existing tools, dies and assembly processes and equipment.

Accordingly, while the present invention has been shown and described with reference to the foregoing preferred embodiments, it will be apparent to those skilled in the art that other changes in form and detail may be made therein without departing from the spirit and scope of the invention as defined in the appended claims.

We claim:

1. An interconnected printhead die and carrier substrate system for a printhead in hard-copy-producing devices used to print on print media, comprising:

a printhead die having an operative face separated from an inner face, and including integrated circuits formed therein;

a carrier substrate having an operative face and an inner face, being coupled to the die, and including integrated circuits formed therein at least three spacers positioned between the die and substrate to define a space therebetween;

an electrical-connection region located adjacent the inner faces of the die and substrate, effective to accommodate bilateral communication between integrated circuits formed on the die and the substrate;

wherein the die has a stepped shape and the substrate has a stepped shape;

and wherein a cavity is formed by the stepped die and stepped substrate, with the electrical-connection region being located in the cavity.

2. The interconnected system of claim 1 wherein the electrical-connection region is encapsulated with an encapsulant.

3. The interconnected system of claim 2 wherein the operative face of the die is not encapsulated.

4. The interconnected system of claim 3 wherein the encapsulant fills the cavity.

5. The interconnected system of claim 4 wherein the encapsulant is chosen from the group consisting of a photo-imageable polyimide, a curable BCB resin, and a curable epoxy resin.

6. The interconnected system of claim 5 wherein the operative face of the die and the operative face of the substrate are in the same plane.

7. An interconnected printhead die and carrier substrate system for a printhead in hard-copy-producing devices used to print on print media, comprising:

a printhead die having an operative face separated from an inner face, and including integrated circuits formed therein;

a carrier substrate having an operative face and an inner face, being coupled to the die, and including integrated circuits formed therein;

at least three spacers positioned between the die and substrate to define a space therebetween an electrical-connection region located adjacent the inner faces of the die and substrate, effective to accommodate bilateral communication between integrated circuits formed on the die and the substrate;

and wherein the operative face of the die and the operative face of the substrate are in the same plane.

8. An interconnected printhead die and carrier substrate system for a printhead in hard-copy-producing devices used to print on print media, comprising:

a printhead die having an operative face separated from an inner face, and including integrated circuits formed therein;

a carrier substrate having an operative face and an inner face, being coupled to the die, and including integrated circuits formed therein;

at least three spacers positioned between the die and substrate to define a space therebetween;

an electrical-connection region located adjacent the inner faces of the die and substrate, effective to accommodate bilateral communication between integrated circuits formed on the die and the substrate; and a protective coating covering the operative and inner faces of the die and the inner face of the substrate.

9. The interconnected system of claim 8 wherein the protective coating has a differentiated thickness in which the thickness is greater where the protective coating covers the operative face of the die and lesser where it covers the inner faces of the die and the substrate.

10. An interconnected printhead die and carrier substrate system for a printhead in hard-copy-producing devices used to print on print media, comprising:

a printhead die having an operative face separated from an inner face, and including integrated circuits formed therein;

a carrier substrate having an operative face and an inner face, being coupled to the die, and including integrated circuits formed therein; and an electrical-connection region located adjacent the inner faces of the die and substrate, effective to accommodate bilateral communication between integrated circuits formed on the die and the substrate;

wherein the die has a stepped shape and the substrate has a stepped shape;

and wherein, a cavity is formed by the stepped die and stepped substrate, with the electrical-connection region being located in the cavity.

11. The interconnected system of claim 10 wherein the electrical-connection region is encapsulated with an encapsulant.

12. The interconnected system of claim 11 wherein the operative face of the die is not encapsulated.

13. The interconnected system of claim 12 wherein the encapsulant fills the cavity.

14. The interconnected system of claim 13 wherein the encapsulant is chosen from the group consisting of a photo-imageable polyimide, a curable BCB resin, and a curable epoxy resin.

15. The interconnected system of claim 14 wherein the operative face of the die and the operative face of the substrate are in the same plane.

16. An interconnected printhead die and carrier substrate system for a printhead in hard-copy-producing devices used to print on print media, comprising:

a printhead die having an operative face separated from an inner face, and including integrated circuits formed therein;

a carrier substrate having an operative face and an inner face, being coupled to the die, and including integrated circuits formed therein;

an electrical-connection region located adjacent the inner faces of the die and substrate, effective to accommodate bilateral communication between integrated circuits formed on the die and the substrate;

and wherein the operative face of the die and the operative face of the substrate are in the same plane.

17. An interconnected printhead die and carrier substrate system for a printhead in hard-copy-producing devices used to print on print media, comprising:

a printhead die having an operative face separated from an inner face, and including integrated circuits formed therein;

a carrier substrate having an operative face and an inner face, being coupled to the die, and including integrated circuits formed therein;

an electrical-connection region located adjacent the inner faces of the die and substrate, effective to accommodate bilateral communication between integrated circuits formed on the die and the substrate; and a protective coating covering the operative and inner faces of the die and the inner face of the substrate.

18. The interconnected system of claim 17 wherein the protective coating has a differentiated thickness in which the thickness is greater where it covers the operative face of the die and lesser where it covers the inner faces of the die and the substrate.

* * * * *